US009574397B1

(12) United States Patent
Cheng

(10) Patent No.: US 9,574,397 B1
(45) Date of Patent: Feb. 21, 2017

(54) CURTAIN SECURITY STRUCTURE DRIVEN BY BEAD CHAIN

(71) Applicant: CHEN TIAN CO., LTD., Tainan (TW)

(72) Inventor: Ching-Hsiang Cheng, Tainan (TW)

(73) Assignee: Chen Tian Co., Ltd., Tainan (TW)

( * ) Notice: Subject to any disclaimer, the term of this patent is extended or adjusted under 35 U.S.C. 154(b) by 0 days.

(21) Appl. No.: 14/859,519

(22) Filed: Sep. 21, 2015

(51) Int. Cl.

| | |
|---|---|
| ***E06B 9/326*** | (2006.01) |
| ***E06B 9/324*** | (2006.01) |
| ***E06B 9/80*** | (2006.01) |
| ***E06B 9/44*** | (2006.01) |
| ***E06B 9/58*** | (2006.01) |
| ***E06B 9/322*** | (2006.01) |
| ***A47H 3/10*** | (2006.01) |
| ***A47H 5/032*** | (2006.01) |

(52) U.S. Cl.
CPC ..... *E06B 9/324* (2013.01); *A47H 3/10* (2013.01); *A47H 5/032* (2013.01); *E06B 9/322* (2013.01); *E06B 9/44* (2013.01); *E06B 9/58* (2013.01); *E06B 9/80* (2013.01); *E06B 2009/3265* (2013.01); *E06B 2009/805* (2013.01)

(58) Field of Classification Search
CPC ..... E06B 2009/3265; E06B 2009/785
USPC ..... 160/321, 178.1 V; 24/115 F
See application file for complete search history.

(56) References Cited

U.S. PATENT DOCUMENTS

| | | | | |
|---|---|---|---|---|
| 6,749,000 | B2 * | 6/2004 | Bohlen | E06B 9/322 160/178.1 R |
| 8,336,598 | B1 * | 12/2012 | Chang | E06B 9/56 160/177 V |
| 2012/0017399 | A1 * | 1/2012 | Huang | E06B 9/326 24/115 F |
| 2016/0069131 | A1 * | 3/2016 | Gramsch | F16H 19/06 160/188 |

FOREIGN PATENT DOCUMENTS

| | | | | |
|---|---|---|---|---|
| NL | WO 2012125036 | A1 * | 9/2012 | E06B 9/326 |

* cited by examiner

*Primary Examiner* — David Purol
(74) *Attorney, Agent, or Firm* — Rosenberg, Klein & Lee

(57) ABSTRACT

The invention relates to a curtain security structure driven by a bead chain, comprising an upper assembler, a lower assembler, and flexible support parts to be assembled correspondingly. A lower rotary wheel of the lower assembler is engaged with an upper rotary wheel of the upper assembler. The two flexible support parts are inserted from the bottom of the lower assembler to assemble the upper and the lower assemblers. An upper bead chain and a lower bead chain are entwined and disposed in upper and lower bead pockets respectively via pockets disposed on struts of the flexible support parts. When children improperly use the curtain security structure and thus are entwined by the lower bead chain and struggle, the lower bead chain, the lower assembler and the flexible support part can simultaneously detach from the upper assembler to prevent the children from being damaged to achieve the safe protection effect.

4 Claims, 9 Drawing Sheets

CURTAIN SECURITY STRUCTURE DRIVEN BY BEAD CHAIN

BACKGROUND

Field of Invention

This invention relates to a curtain security structure driven by a bead chain. More particularly, this invention relates to a new design for a curtain security structure driven by a bead chain. This curtain security structure can prevent the children from danger and reach an effect of safe protection, as well as thus increase the practical functions thereof to be a novel design.

Description of Related Art

All of the present curtain designs use flexible ropes in the rolling structure of curtains to be the operation medium for facilitating the users to pull the curtains up and down, or in a horizontal direction, to collapse or expand the curtains.

A general curtain structure is mainly wounding a curtain on a shaft connecting to a retractor. A bead chain is disposed on the retractor. The retractor is controlled by pulling the bead chain to drive the retractor rotating forward or backward to control the rise or fall of the curtain. However, the bead chain is an annular body and has a relatively high toughness. Therefore, when a neck of a child, having shallow understanding or in play, is wrapped by a bead chain, accidents can easily occur if the child's struggling is unable to free himself or herself from the bead chain.

SUMMARY

This invention mainly provides a curtain security structure driven by a bead chain. When children improperly use the curtain security structure and thus are entwined by a lower bead chain and struggle, a lower bead chain, a lower assembler and a flexible support part can simultaneously detach from an upper assembler to prevent the safety damaging condition from occurring to the children to achieve the safe protection effect. The practical convenience is increased when the curtain security structure driven by a bead chain is used as a whole.

In this invention, the main purpose and effect of the curtain security structure driven by a bead chain are reached by the following technical means.

The curtain security structure mainly comprising an upper assembler, a lower assembler, and flexible support parts to be assembled correspondingly;

wherein an upper rotary wheel is pivotally disposed in the upper assembler, an upper tooth part is formed on a rim of the upper rotary wheel, a plurality of upper bead pockets is recessedly disposed to surround the upper rotary wheel for accommodating an upper bead chain, a positioning part is disposed in the upper assembler, and two corresponding position embedded slots are recessedly disposed on two sides of the positioning part;

wherein a lower rotary wheel is pivotally disposed in the lower assembler, a lower tooth part is formed on a rim of the lower rotary wheel and engaged with the upper tooth part of the upper rotary wheel, a plurality of lower bead pockets is recessedly disposed to surround the lower rotary wheel, and clamp holes are correspondingly disposed on two sides of the lower assembler; and wherein clamp convex parts are convexly disposed on the flexible support parts to correspond with clamping holes of the lower assembler, whereby the flexible support parts are inserted into the lower assembler from the bottom thereof and fixed thereto by clamping the clamp convex parts in the clamping holes of the lower assembler, positioning rods are raised on the flexible support parts to correspond with the positioning part of the upper assembler, position embedded parts are disposed on the positioning rods to correspond with the position embedded slots of the positioning part, top struts are protruding from the flexible support parts and support the lower assembler in the inner side thereof, struts are obliquely protruding from the bottom end of the flexible support parts, and pockets are recessedly disposed on the struts to allow a lower bead chain disposed in the plurality of lower bead pockets through the pockets.

In a preferred embodiment of this invention, upper pivot bores are disposed on the front and rear surfaces of the upper assembler, upper guiding slots are formed by extending outwardly from the upper pivot bores of the upper assembler, and upper pivot axes are formed by outwardly extending from the front and rear surfaces of the upper rotary wheel, so that the upper pivot axes are pushed into the upper pivot bores from the upper guiding slots to pivotally dispose the upper rotary wheel.

In another preferred embodiment of this invention, lower pivot bores are disposed on the front and rear surfaces of the lower assembler, lower guiding slots are formed by extending outwardly from the lower pivot bores of the lower assembler, lower pivot axes are formed by outwardly extending from the front and rear surfaces of the lower rotary wheel, so that the lower pivot axes of the lower rotary wheel are pushed into the lower pivot bores from the lower guiding slots to pivotally dispose the lower rotary wheel.

DETAILED DESCRIPTION

In order to have a more complete and clear disclosure of the technical content, purpose and effect of this invention, the technical content, purpose and effect of this invention are detailed illustrated below. The disclosed figures and reference numbers thereof are referred at the same time.

Figure 1:
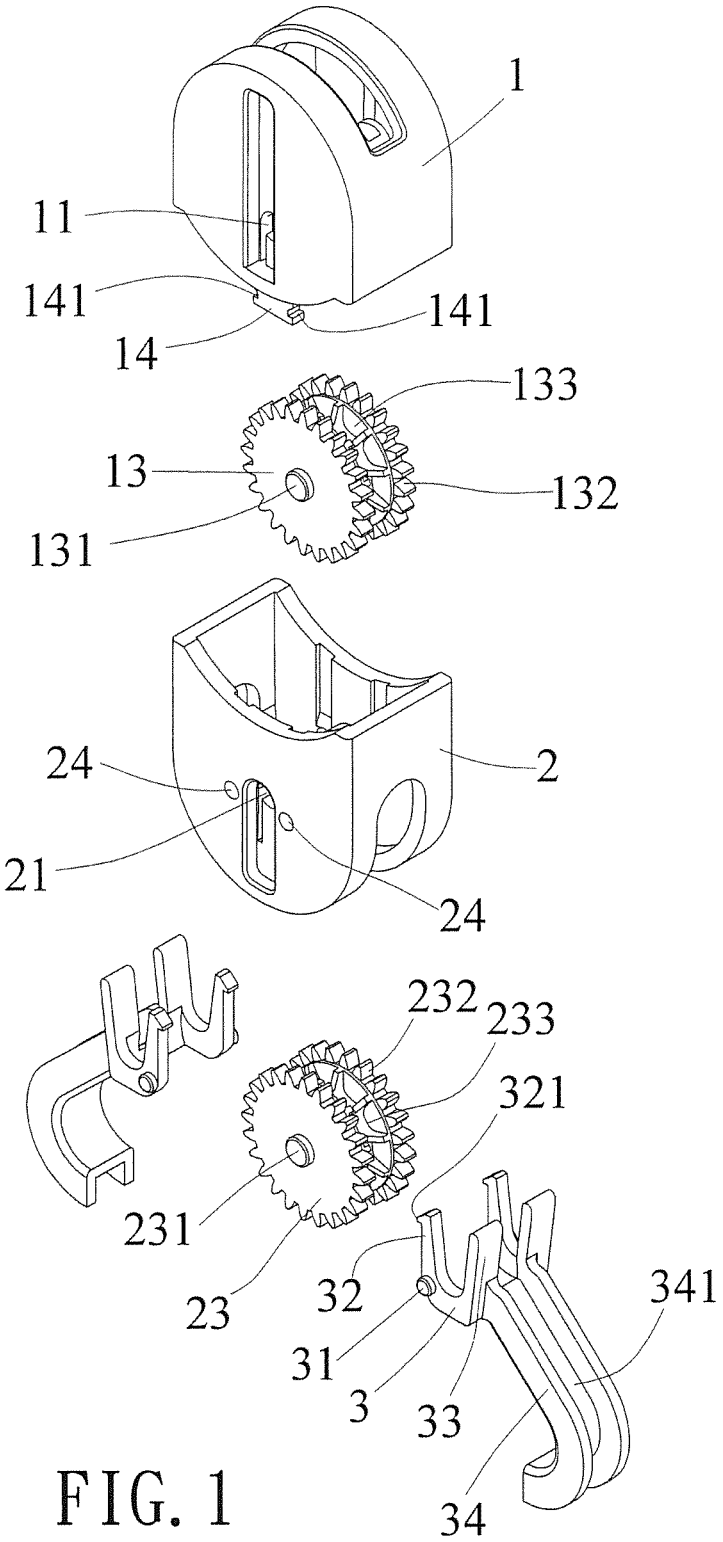
FIG. 1 is an exploded perspective structure diagram of this invention.
Figure 2:
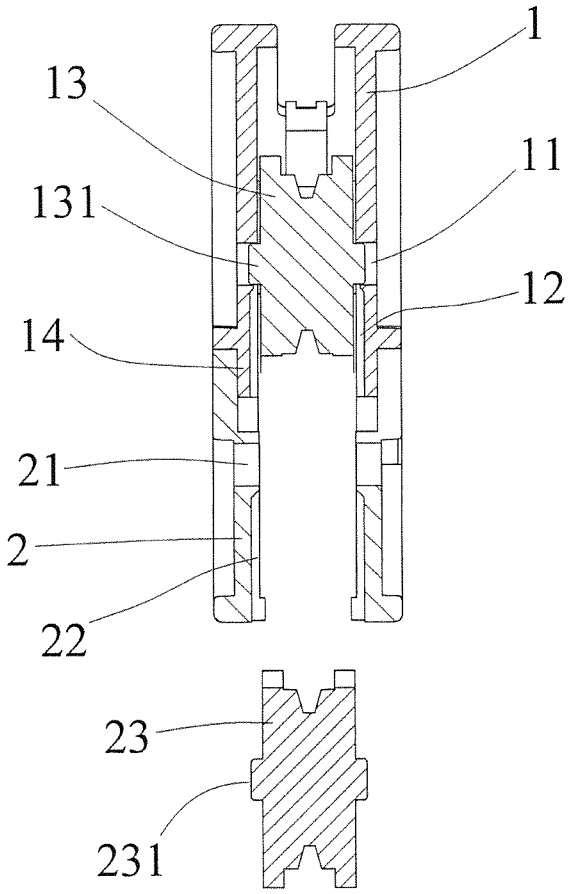
FIG. 2 is a schematic side cross-sectional diagram to show an assembled action of this invention.
Figure 3:
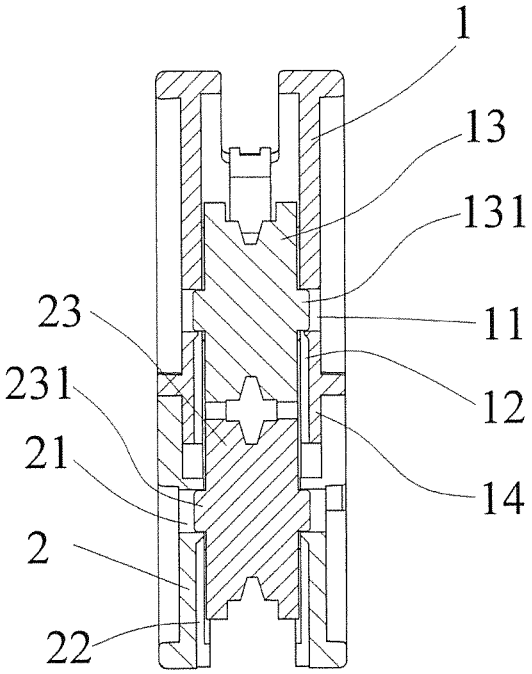
FIG. 3 is a schematic side cross-sectional diagram to show an assembled structure of this invention.

Referring FIGS. 1-3, wherein FIG. 1 is an exploded perspective structure diagram of this invention, FIG. 2 is a schematic side cross-sectional diagram to show an assembled action of this invention, and FIG. 3 is a schematic side cross-sectional diagram to show an assembled structure of this invention. This invention mainly comprises an upper assembler (1), a lower assembler (2), and flexible support parts (3) to be assembled correspondingly.

Upper pivot bores (11) are disposed on the front and rear surfaces of the upper assembler (1) above. Upper guiding slots (12) are formed by extending outwardly from the upper pivot bores (11) of the upper assembler (1). An upper rotary wheel (13) is disposed in the upper assembler (1). An upper pivot axis (131) is formed by outwardly extending from the front and rear surfaces of the upper rotary wheel (13). The upper pivot axis (131) of the upper rotary wheel (13) is pushed into the upper pivot bore (11) from the upper guiding slots (12) to pivotally dispose the upper rotary wheel (13). An upper tooth part (132) is disposed on an outer rim of the upper rotary wheel (13). A plurality of upper bead pockets (133) is recessedly disposed to surround the upper rotary wheel (13). A positioning part (14) is disposed in the upper assembler (1), and two corresponding position embedded slots (141) are recessedly disposed on both sides of the positioning part (14).

The lower assembler (2) is used to be assembled with the upper assembler (1). Lower pivot bores (21) are disposed on the front and rear surfaces of the lower assembler (2). Lower guiding slots (22) are formed by extending outwardly from the lower pivot bores (21) of the lower assembler (2). A lower rotary wheel (23) is disposed in the lower assembler (2). A lower pivot axis (231) is formed by outwardly extending from the front and rear surfaces of the lower rotary wheel (23). The lower pivot axis (231) of the lower rotary wheel (23) is pushed into the lower pivot bores (21) from the lower guiding slots (22) to pivotally dispose the lower rotary wheel (23). A lower tooth part (232) is disposed on an outer rim of the lower rotary wheel (23). The lower tooth part (232) may be used to be engaged with the upper tooth part (132) of the upper rotary wheel (13) in the upper assembler (1). A plurality of lower bead pockets (233) is recessedly disposed to surround the lower rotary wheel (23). Two corresponding clamping holes (24) are disposed on two sides of the lower assembler (2).

The flexible support parts (3) have clamp convex parts (31), which are convexly disposed to correspond with the clamping holes (24) of the lower assembler (2). The flexible support parts (3) may be inserted into the lower assembler (2) from the bottom of the lower assembler (2) and fixed to the lower assembler (2) by clamping the clamp convex parts (31) in the clamping holes (24) of the lower assembler (2). Positioning rods (32) are raised on the flexible support parts (3) to correspond with the positioning parts (14) of the upper assembler (1). Position embedded parts (321) are disposed on the positioning rods (32) to correspond with the position embedded slots (141) of the positioning parts (14). The position embedded parts (321) are used to assemble and fix the positioning rods (32) with the position embedded slots (141) of the positioning parts (14). Top struts (33) are protruding from the flexible support parts (3) and support the lower assembler (2) in the inner side of the lower assembler (2). Struts (34) are obliquely protruding from the bottom end of the flexible support parts (3), and pockets (341) are recessedly disposed on the struts (34).

Figure 4:
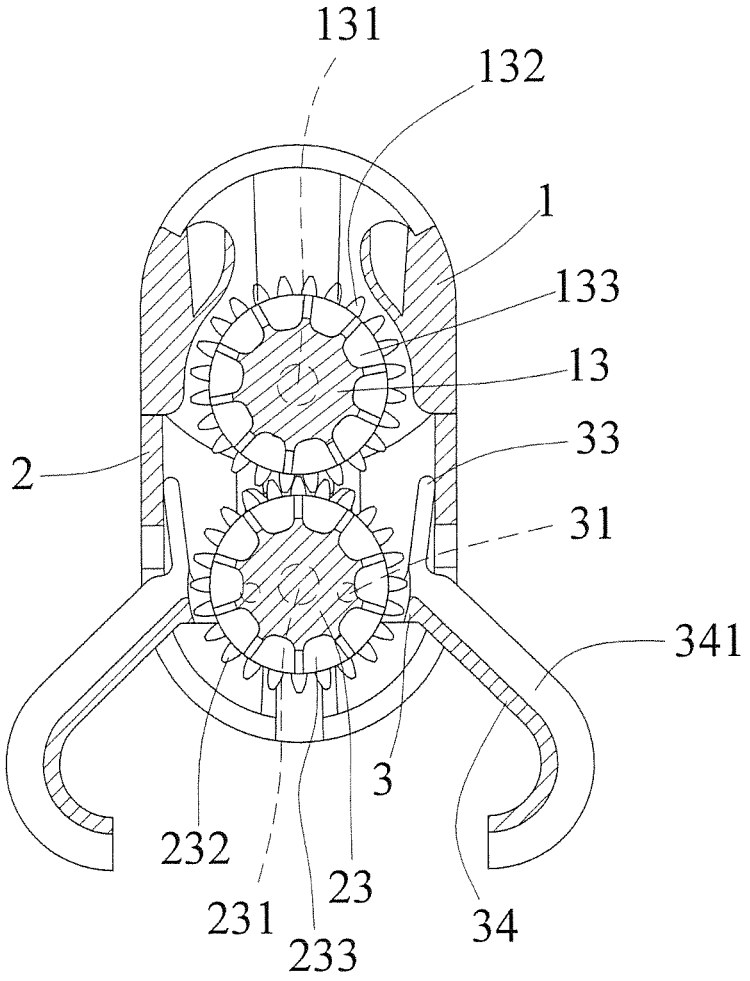
FIG. 4 is a schematic front cross-sectional diagram to show an assembled structure of this invention.
Figure 5:
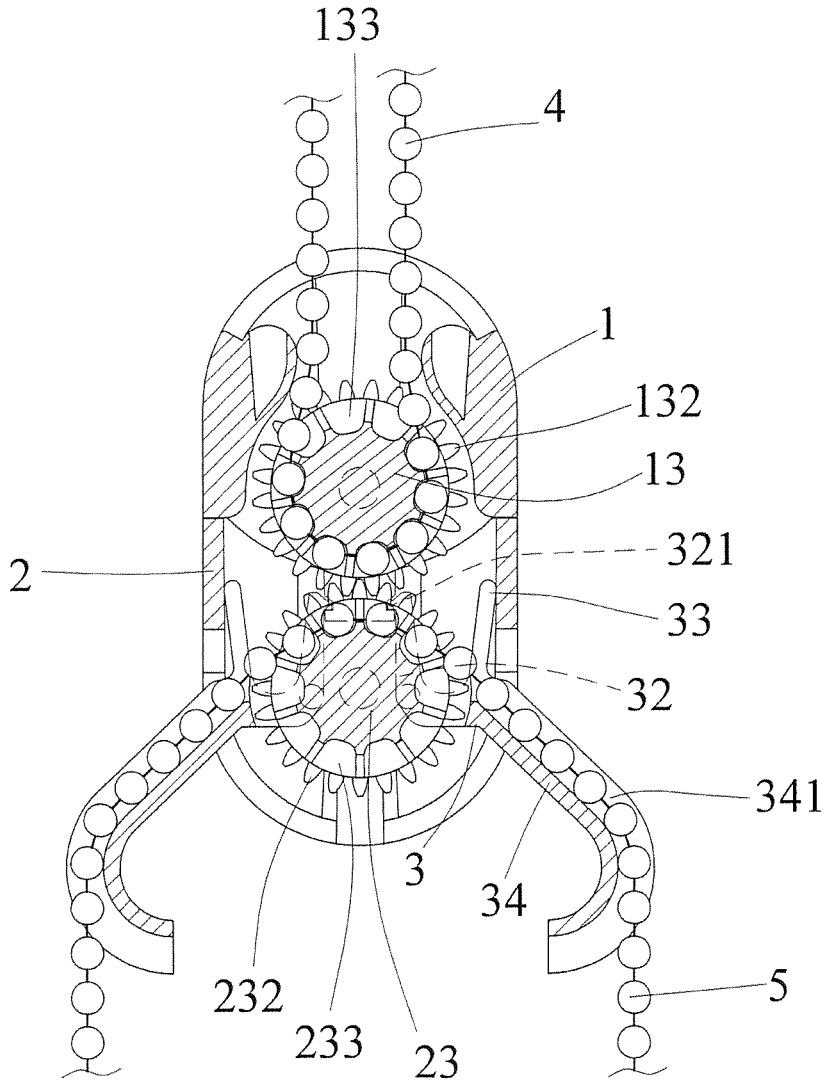
FIG. 5 is a schematic front cross-sectional diagram to show a use condition of this invention.

FIG. 4 is a schematic front cross-sectional diagram to show an assembled structure of this invention, and FIG. 4 is also referred below. When the components above are assembled, the upper pivot axis (131) of the upper rotary wheel (13) is pushed into the upper pivot bores (11) from the upper guiding slots (12) to pivotally dispose the upper rotary wheel (13). The lower pivot axis (231) of the lower rotary wheel (23) is pushed into the lower pivot bores (21) from the lower guiding slots (22) of the lower assembler (2) to pivotally dispose the lower rotary wheel (23). The upper assembler (1) and the lower assembler (2) are jointly assembled, and the lower tooth part (232) of the lower rotary wheel (23) is engaged with the upper tooth part (132) of the upper rotary wheel (13). The flexible support parts (3) may be inserted and fixed into the lower assembler (2) from the bottom of the lower assembler (2) by clamping the clamp convex parts (31) in the clamping holes (24) of the lower assembler (2). The position embedded parts (321) of the positioning rods (32) are used to assemble and fix the flexible support parts (3) with the position embedded slots (141) of the positioning parts (14). At this time, the top struts (33) of the flexible support parts (3) support the lower assembler (2) in the inner side of the lower assembler (2). The struts (34) of the flexible support parts (3) are protruding outside the lower assembler (2) to use the flexible support parts (3) to assemble the lower assembler (2) with the upper assembler (1). Thus, an upper bead chain (4) installed on a curtain rod can be disposed in the upper bead pockets (133) to surround the upper rotary wheel (13), and a lower bead chain (5) also can be disposed in the plurality of lower bead pockets (233) to surround the lower rotary wheel (23) via the pockets (341) recessedly disposed in the struts (34) of the flexible support parts (3). Please also refer to FIG. 5, which is a schematic front cross-sectional diagram to show a use condition of this invention.

Figure 6:
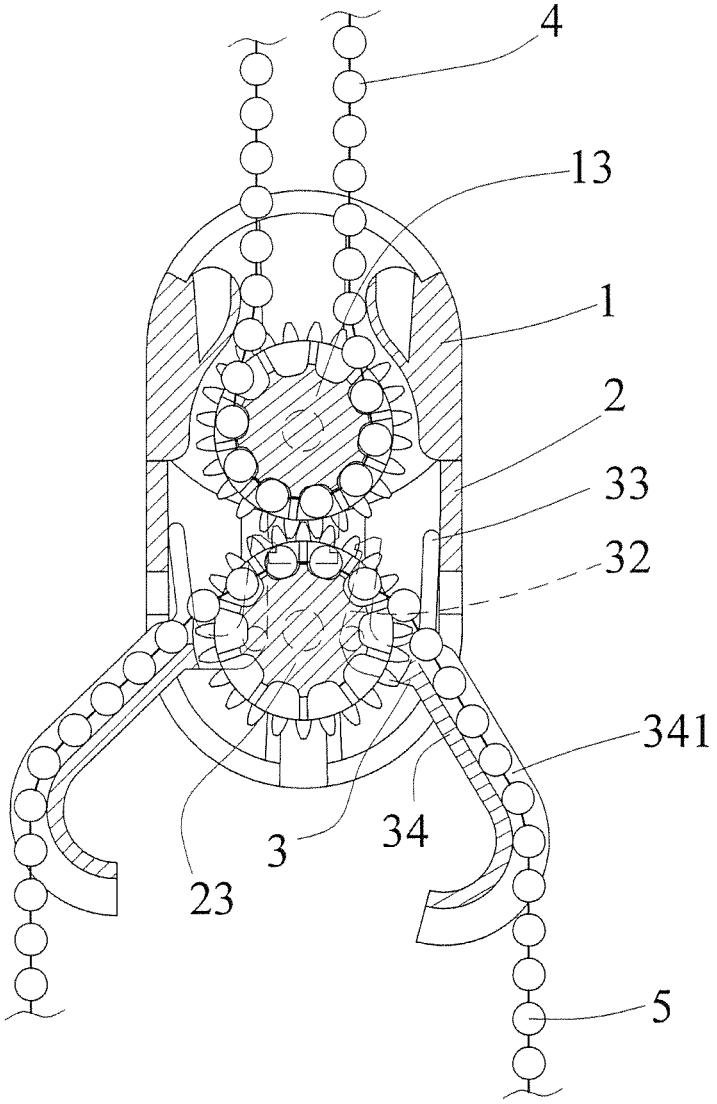
FIG. 6 is a front cross-sectional diagram (1) to show a unilateral pull state of this invention.
Figure 7:
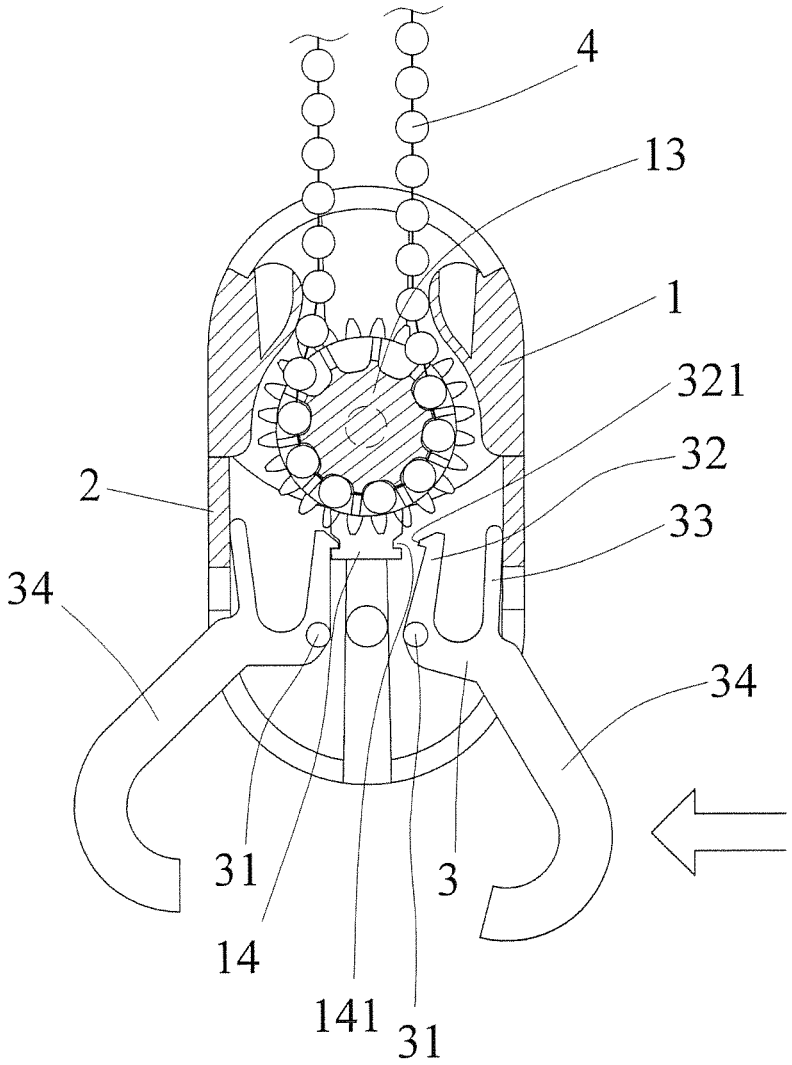
FIG. 7 is a front cross-sectional diagram (2) to show a unilateral pull state of this invention.

Please refer to FIGS. 6 and 7 together. FIG. 6 is a front cross-sectional diagram (1) to show a unilateral pull state of this invention, and FIG. 7 is a front cross-sectional diagram (2) to show a unilateral pull state of this invention. When a user pulls a side of the lower bead chain (5) to control the opening or closing of the curtain, one of the struts (34) of the flexible support parts (3) will be driven and then retracted to detach the position embedded part (321) of the positioning rod (32) of the flexible support part (3) from the position embedded slot (141) of the positioning part (14) since the lower bead chain (5) is only pulled at one side. Meanwhile, the other position embedded part (321) of the positioning rod (32) of the flexible support part (3) is still clamped with the position embedded slot (141) of the positioning part (14) to combine the lower assembler (2) and the upper assembler (1) without detachment. The upper wheel (13) can synchronously rotate with the lower rotary wheel (23) to bear 15 kg of unilateral pulling force when the lower bead chain (5) is used to control the rotation of the lower rotary wheel (23), since the lower tooth part (232) of the lower rotary wheel (23) is engaged with the upper tooth part (132) of the upper rotary wheel (13). Then, the upper bead chain (4) is driven by the upper rotary wheel (13) to control the opening and closing of the curtain.

Figure 8:
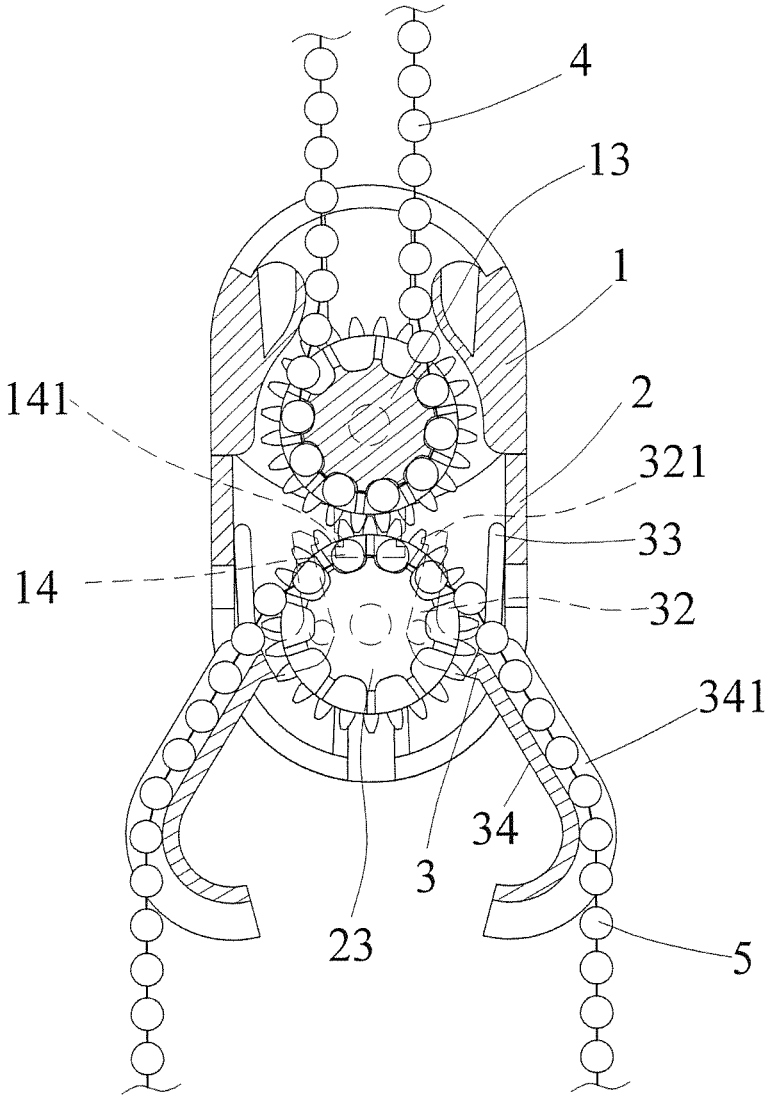
FIG. 8 is a front cross-sectional diagram to show a detachment action of this invention.
Figure 9:
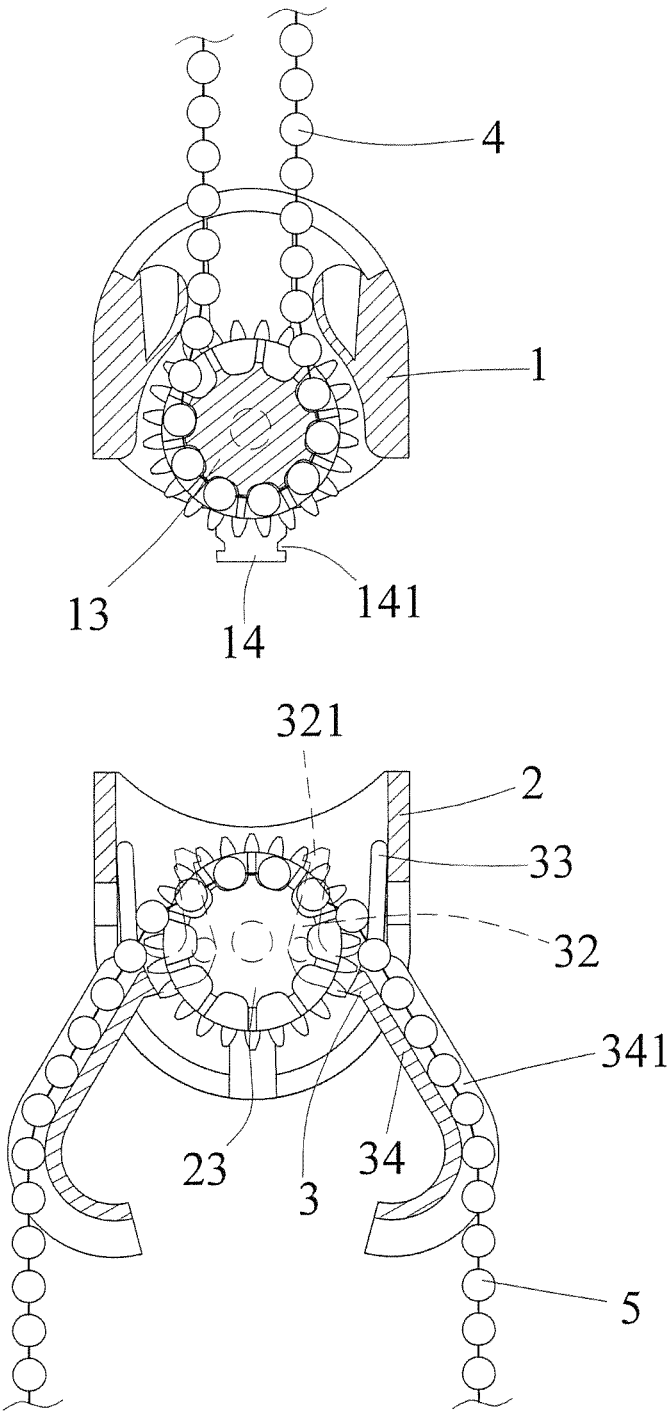
FIG. 9 is a front cross-sectional diagram to show a detachment condition of this invention.

Moreover, a child may be entwined by the lower bead chain (5) to be in a pulling situation when the child improperly uses it. Please also refer FIG. 8, which is a front cross-sectional diagram to show a detachment action of this invention. Since both sides of the lower bead chain (5) on the struts (34) of the flexible support parts (3) may be pulled by two hands of a child, a safe detachment will occur when the pulling force on the lower bead chain (5) is greater than 3 kg. It is in a condition that the struts (34) of the two flexible support parts (3) are driven to be contracted, and thus the position embedded parts (321) of the positioning rods (32) of the flexible support parts (3) are detached from the position embedded slots (141) of the positioning part (14). Hence, the lower assembler (2) loses the support and position limiting functions of the flexible support parts (3) to make the lower assembler (2) detach from the upper assembler (1). Please also refer to FIG. 9, which is a front cross-sectional diagram to show a detachment condition of this invention. The detachment of the lower assembler (2)

from the upper assembler (1) can prevent the safety damaging condition from occurring to children.

The industry advantages of this invention include:

1. Children may be entwined by the lower bead chain to be in a pulling situation when the children use it improperly. Since both sides of the lower bead chain may be pulled down at the same time. When the pulling force is greater than 3 kg, a detaching movement is performed to generate a safety detachment. The positioning rods of the two flexible support parts will act at the same time. The both position embedded parts of the positioning rods will detach from the positioning part to let the lower assembler and the lower bead chain simultaneously detach to form a safety guarding mechanism to the children.

2. Only one side of the lower bead chain can be pulled down when use it properly. The bearable pulling force can reach 15 kg. Therefore, the curtain security structure can be smoothly used for french windows or for heavier curtains up to 15 kg.

In light of the embodiments in this invention above, it may be known that this invention can detach the lower bead chain as well as the lower assembler and the flexible support part from the upper assembler when a child is entwined by the lower bead chain and struggling. Therefore, a damage situation to the children's safety can be prevent from occurring to gain the effect of safe protection and increase the practical convenience when it is used as a whole.

What is claimed is:

1. A curtain security structure driven by a bead chain, the curtain security structure comprising:

an upper assembler and a lower assembler releasably coupled to the upper assembler by a plurality of flexible support parts, wherein an upper rotary wheel is pivotally disposed in the upper assembler, an upper tooth part is formed on an outer rim of the upper rotary wheel, a plurality of upper bead pockets are defined by recesses formed along the upper rotary wheel for accommodating an upper bead chain, a positioning part is disposed in the upper assembler, the positioning part forming position embedded slots disposed on two sides thereof;

wherein a lower rotary wheel is pivotally disposed in the lower assembler, a lower tooth part is formed on an outer rim of the lower rotary wheel, the lower tooth part is engaged with the upper tooth part of the upper rotary wheel, a plurality of lower bead pockets are defined by recesses formed along the lower rotary wheel, the lower assembler having clamp holes formed on two sides thereof;

wherein each of the flexible support parts includes:

a plurality of clamp convex parts are disposed to engage the clamping holes of the lower assembler when the flexible support parts are inserted into the lower assembler from the bottom thereof, a positioning rod extending to correspond with the positioning part of the upper assembler, the positioning rod having a position embedded part configured to retentively engage one of the position embedded slots of the positioning part of the upper assembler, a top strut extending to engage an inner side of the lower assembler, and a bottom strut obliquely protruding to define a recessed pocket extending therealong to guide a lower bead chain;

wherein the lower assembler safely decouples from the upper assembler when the positioning rod of each flexible support part deflects relative to the top strut to disengage the position embedded part from a corresponding one of the embedded slots responsive to application of a predetermined downward force on the bottom strut by the lower bead chain.

2. The curtain security structure of claim 1, wherein upper pivot bores are disposed on the front and rear surfaces of the upper assembler, upper guiding slots are formed to extend outward from the upper pivot bores of the upper assembler, and an upper pivot axis is formed to extend from each of the front and rear surfaces of the upper rotary wheel to be guided into engagement with the upper pivot bores by the upper guiding slots for pivotal support of the upper rotary wheel.

3. The curtain security structure of claim 1, wherein lower pivot bores are disposed on the front and rear surfaces of the lower assembler, lower guiding slots are formed to extend outward from the lower pivot bores of the lower assembler, a lower pivot axis is formed to extend from each of the front and rear surfaces of the lower rotary wheel to be guided into engagement with the lower pivot bores by the lower guiding slots for pivotal support of the lower rotary wheel.

4. The curtain security structure of claim 1, wherein the positioning rod and top strut of each flexible support part collectively define a substantially U-shaped configuration.

* * * * *